US008651327B2

(12) United States Patent
Cutting et al.

(10) Patent No.: US 8,651,327 B2
(45) Date of Patent: Feb. 18, 2014

(54) SYSTEMS AND METHODS FOR USE IN STORING BIOPHARMACEUTICAL MATERIALS

(75) Inventors: Jonathan Cutting, Fairfield, CA (US); Oscar Werner Reif, Hannover (DE)

(73) Assignee: Sartorius Stedim North America Inc., Bohemia, NY (US)

( * ) Notice: Subject to any disclaimer, the term of this patent is extended or adjusted under 35 U.S.C. 154(b) by 214 days.

(21) Appl. No.: 13/024,085

(22) Filed: Feb. 9, 2011

(65) Prior Publication Data

US 2012/0199614 A1 Aug. 9, 2012

(51) Int. Cl.
*B67D 7/78* (2010.01)

(52) U.S. Cl.
USPC ..... 222/1; 222/464.2; 222/105; 138/123; 138/124

(58) Field of Classification Search
USPC ..... 222/464.2, 105, 1, 464.3, 464.1, 382; 138/119, 123, 124
See application file for complete search history.

(56) References Cited

U.S. PATENT DOCUMENTS

| | | | | |
|---|---|---|---|---|
| 2,859,899 A | | 11/1958 | Kramer et al. | |
| 2,918,394 A | * | 12/1959 | Smith | 138/146 |
| 3,240,399 A | * | 3/1966 | Frandeen | 222/211 |
| 3,830,067 A | * | 8/1974 | Osborn et al. | 405/45 |
| 3,939,875 A | * | 2/1976 | Osborn et al. | 138/178 |
| 4,138,036 A | | 2/1979 | Bond | |
| 4,286,636 A | | 9/1981 | Credle | |
| 4,524,458 A | * | 6/1985 | Pongrass et al. | 383/33 |
| 4,601,410 A | * | 7/1986 | Bond | 222/92 |

(Continued)

FOREIGN PATENT DOCUMENTS

| | | |
|---|---|---|
| DE | 7415521 U | 1/1976 |
| DE | 3919360 A1 | 12/1990 |

(Continued)

OTHER PUBLICATIONS

PCT/ISA/220 Notification of Transmittal of the International Search Report and the Written Opinion of the International Searching Authority or the Declaration dated May 31, 2012 regarding International Patent Application No. PCT/US2012/022891.

(Continued)

*Primary Examiner* — Kevin P Shaver
*Assistant Examiner* — Michael Melaragno
(74) *Attorney, Agent, or Firm* — Heslin Rothenberg Farley & Mesiti P.C.; Nicholas Mesiti, Esq.; Victor A. Cardona, Esq.

(57) ABSTRACT

A system for storing biopharmaceutical materials includes a plurality of flexible walls bounding an interior for holding biopharmaceutical materials therein. At least one port is connected to a first wall of the walls and provides fluid communication between the interior and an exterior to allow a draining of the interior. A collapsible conduit includes a plurality of perforations along the conduit. The plurality of perforations is configured to allow flow of the biopharmaceutical materials from the exterior to the interior of the conduit. The conduit has a cross-sectional area transverse to a length of the conduit and the conduit extends from one of the at least one port toward an opposite end of the interior. The conduit is collapsible by the flexible walls and forms a reduced cross-sectional area to allow a flow of the biopharmaceutical materials through and/or along the conduit to the port.

18 Claims, 11 Drawing Sheets

(56) References Cited

U.S. PATENT DOCUMENTS

| | | | | | |
|---|---|---|---|---|---|
| 4,892,712 | A | * | 1/1990 | Robertson et al. | 422/186 |
| 4,966,759 | A | * | 10/1990 | Robertson et al. | 422/186 |
| 5,032,241 | A | * | 7/1991 | Robertson et al. | 204/157.15 |
| 5,647,511 | A | | 7/1997 | Bond | |
| 5,728,086 | A | * | 3/1998 | Niedospial, Jr. | 604/408 |
| 5,730,328 | A | * | 3/1998 | Maeder et al. | 222/95 |
| 5,749,493 | A | * | 5/1998 | Boone et al. | 222/105 |
| 5,915,596 | A | * | 6/1999 | Credle, Jr. | 222/105 |
| 5,941,421 | A | * | 8/1999 | Overman et al. | 222/105 |
| 6,045,006 | A | * | 4/2000 | Frazier et al. | 222/105 |
| 6,045,546 | A | * | 4/2000 | Drago et al. | 604/408 |
| 6,102,252 | A | * | 8/2000 | Overman et al. | 222/105 |
| 2004/0138644 | A1 | * | 7/2004 | DiCarlo et al. | 604/524 |
| 2007/0217719 | A1 | | 9/2007 | Smith | |
| 2009/0182263 | A1 | * | 7/2009 | Burbank et al. | 210/257.1 |
| 2011/0006015 | A1 | * | 1/2011 | Leonard et al. | 210/767 |

FOREIGN PATENT DOCUMENTS

| | | | | |
|---|---|---|---|---|
| EP | 0444982 | A1 | | 9/1991 |
| EP | 1044661 | A2 | | 10/2000 |
| WO | WO 86/00868 | | | 2/1986 |
| WO | WO86/00868 | | * | 2/1986 |
| WO | WO 8600868 | A1 | * | 2/1986 |

OTHER PUBLICATIONS

PCT/ISA/210 International Search Report dated May 31, 2012 issued by Ralph Tiede of the European Patent Office.

PCT/ISA/237 Written Opinion of the International Searching Authority dated May 31, 2012 issued by Ralph Tiede of the European Patent Office.

* cited by examiner

SYSTEMS AND METHODS FOR USE IN STORING BIOPHARMACEUTICAL MATERIALS

TECHNICAL FIELD

This invention relates, in general, to biopharmaceutical materials, and more particularly to systems and methods for storing biopharmaceutical materials.

BACKGROUND ART

Biopharmaceutical materials are often held in single-use bulk storage containers such as plastic bags or other flexible containers. Such single-use containers or bags are commonly drained by gravity through a port located on the bottom of the bag. Although this method is effective in recovering product from the container, it has some disadvantages. Large capacity bags (here defined as 50 L or greater) are commonly handled as bag-in-box systems (e.g, a flexible container in a more rigid structure) since the bag is generally not self-supporting and requires protection against damage. Installation of a bottom drain in a bag-in-box structure requires that an operator manipulate a drain line of the bag such that it passes from the inside of the box to the outside of the box. The drain line may then be located outside the protective structure of the box and may be damaged during transportation and handling. A bottom port may be also be damaged by a combination of improper installation and hydrostatic pressure. Furthermore, if containment is desired in the event of a leak in the bag, then the hole in the box creates a path for leakage into the surrounding environment.

Various systems are known for draining a single use bag through a port located on the top of the bag. If no dip tube is provided then the flexible bag walls of such a container usually collapse and block flow, thereby preventing full recovery of the fluid inside. It is possible in some cases to manipulate the bag during the draining process in order to reduce the risk of blockage (and minimize the amount of liquid which is not recovered or the "holdup volume"), but this requires manual intervention and creates an "accordion" with many random folds and unreliable performance. A dip tube may be run from the drain port located at the top of the bag down to the bottom of the bag. However, this approach is problematic for several reasons. First, the flexible bag wall commonly collapses over the end of the dip tube and thereby prevents full recovery of the fluid inside. Also, if the end of the dip tube drifts away from the bottom of the bag then it may become trapped between collapsing bag walls, thereby preventing full recovery of the fluid inside.

Thus, there is a need for systems and methods for storing biopharmaceutical materials, which minimize a hold up volume of liquid in containers holding such materials and facilitate evacuation of the containers.

SUMMARY OF THE INVENTION

The present invention provides, in a first aspect, a system for storing biopharmaceutical materials which includes a plurality of flexible walls bounding an interior for holding biopharmaceutical materials therein. At least one port is connected to a first wall of the walls and provides fluid communication between the interior and an exterior to allow a draining of the interior. A collapsible conduit includes a plurality of perforations along the conduit. The plurality of perforations is configured to allow flow of the biopharmaceutical materials along the conduit. The conduit has a cross-sectional area transverse to a length of the conduit and the conduit extends from one of the at least one port toward an opposite end of the interior. The conduit is collapsible by the flexible walls and forms a reduced cross-sectional area when the container is drained to allow a flow of the biopharmaceutical materials along the conduit to the port.

The present invention provides, in a second aspect, a method for removing biopharmaceutical materials from a flexible container, the method including pumping the biopharmaceutical materials through and/or along a collapsible conduit in an interior of the flexible container to a port of the flexible container. The port provides fluid communication between the interior of the flexible container and an exterior of the flexible container. A plurality of perforations of the collapsible conduit allows flow of the biopharmaceutical materials from an exterior to an interior of the conduit. The conduit extends from the port toward an opposite end of the interior.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of preferred embodiments taken in conjunction with the accompanying drawings in which:

DETAILED DESCRIPTION

Figure 1:
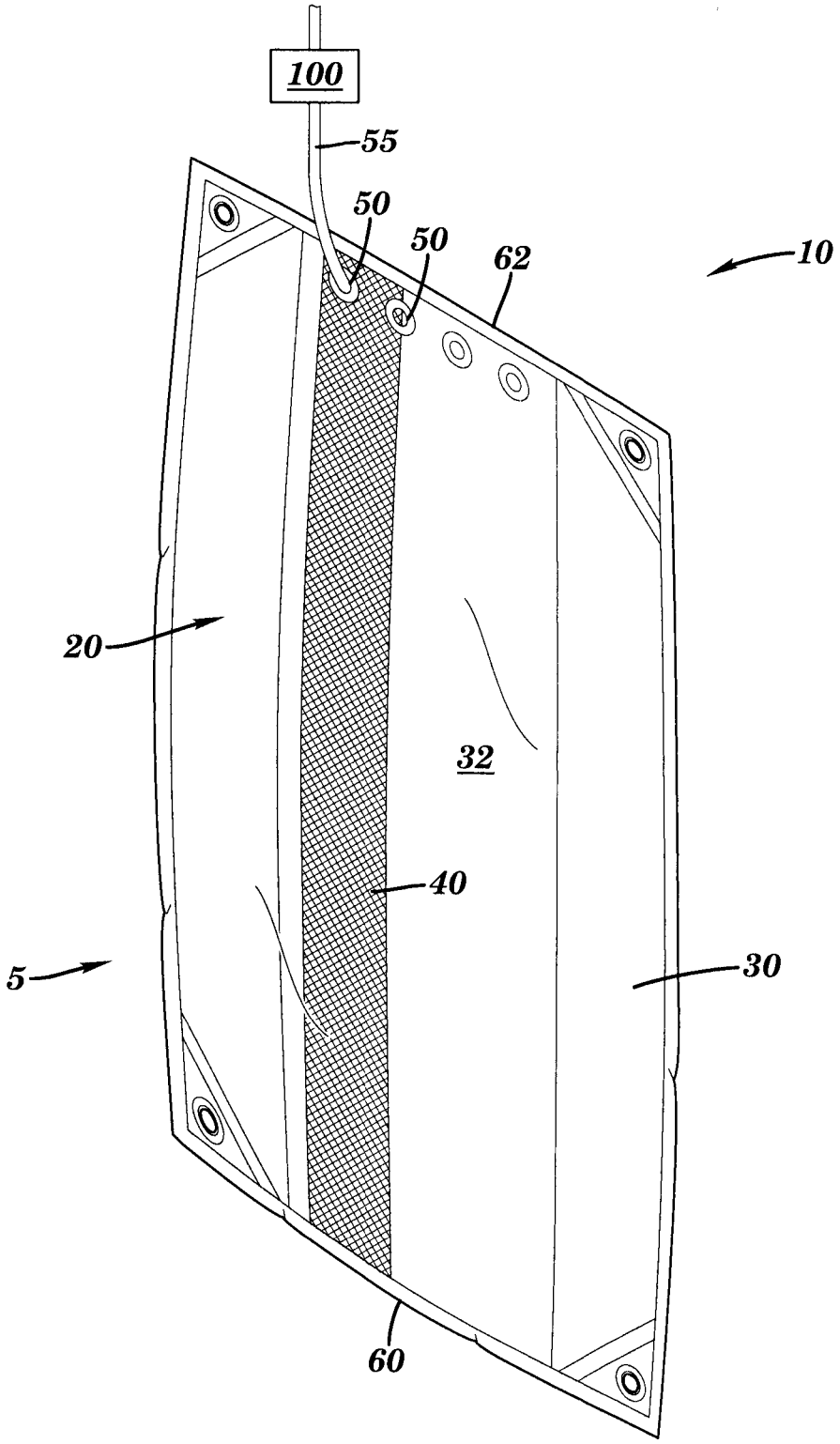
FIG. 1 is a perspective view of a system for storing biopharmaceutical materials in accordance with the present invention.

In accordance with the principles of the present invention, systems and methods for biopharmaceutical materials are provided.

In an exemplary embodiment depicted in FIGS. 1-13, a system 5 for storing biopharmaceutical materials is shown. The system may include a sterile container, such as a flexible container 10 in the form of a bag, configured to contain the biopharmaceutical materials.

Container 10 includes an interior 20 bounded by flexible walls 30 of the container. A conduit (e.g., a dip tube) 40 may be attached to a wall 32 of walls 30. Wall 32 may also include a port 50 (or multiple ports) allowing fluid communication between interior 20 and an exterior of container 10 to allow the interior to be drained of biopharmaceutical materials or another liquid held in the interior. Conduit 40 may be attached to wall 32 such that conduit 40 extends from the port toward an opposite end 60 of container 10, and the conduit may reach the opposite end. Conduit 40 could be attached to wall 32 along an entire length of conduit 40. In another example, conduit 40 could be attached to a second wall of walls 30 opposite wall 32 about interior 20 such that port 50 and conduit 40 are attached to different walls opposite one another about the interior.

Figure 5:
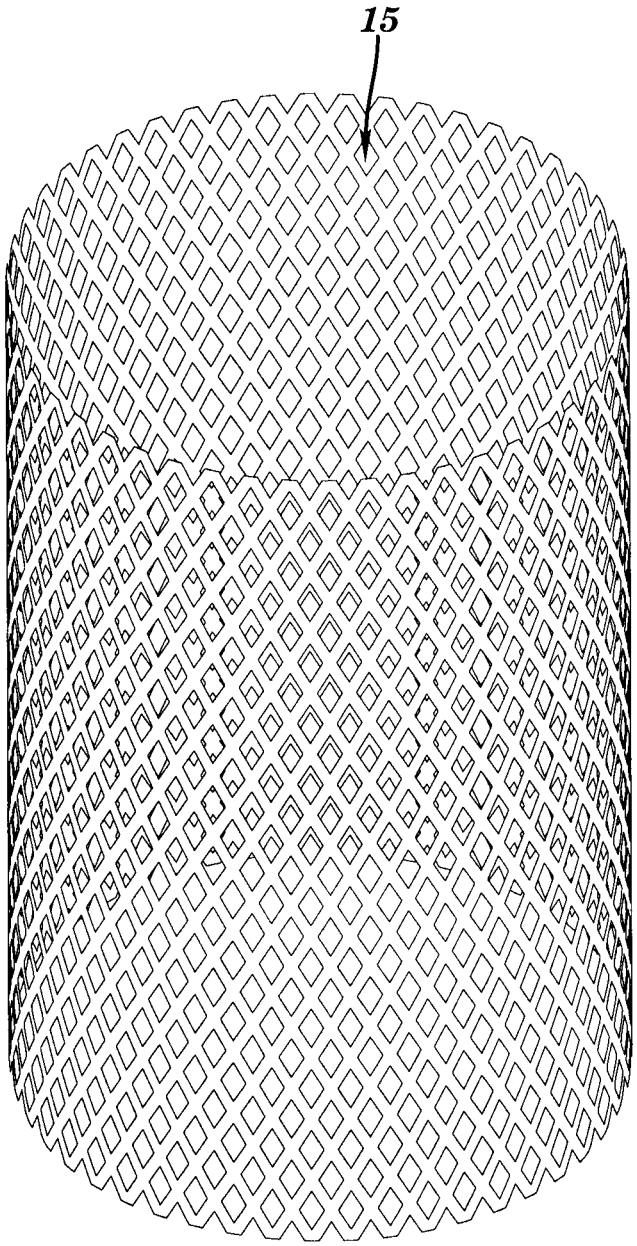
FIG. 5 is a perspective view of a mesh conduit used to form a conduit depicted in the system of FIG. 1.

Conduit 40 may also be formed of a collapsible mesh formed in the shape of a tube or cylinder as depicted in FIG. 5, for example. The mesh may be formed of a same material (e.g., LDPE) as container 10 and may be attached to container 10 by ends of the mesh tube being welded into the seams of container 10, or conduit 40 and container 10 may be welded together using an impulse sealer. Alternatively, conduit 40 may be continuously attached (e.g., via welding) to wall 32 along an entire length thereof. The multiple holes or perforations in the mesh allow the biopharmaceutical material held in container 10 to enter an interior portion 15 of conduit 40 in multiple locations along the length of the conduit. The holes or perforations of the mesh may be evenly or unevenly spaced along a length of the conduit. Such perforations or holes may be located along an entire length of the conduit or a portion or portions thereof.

Figure 2:
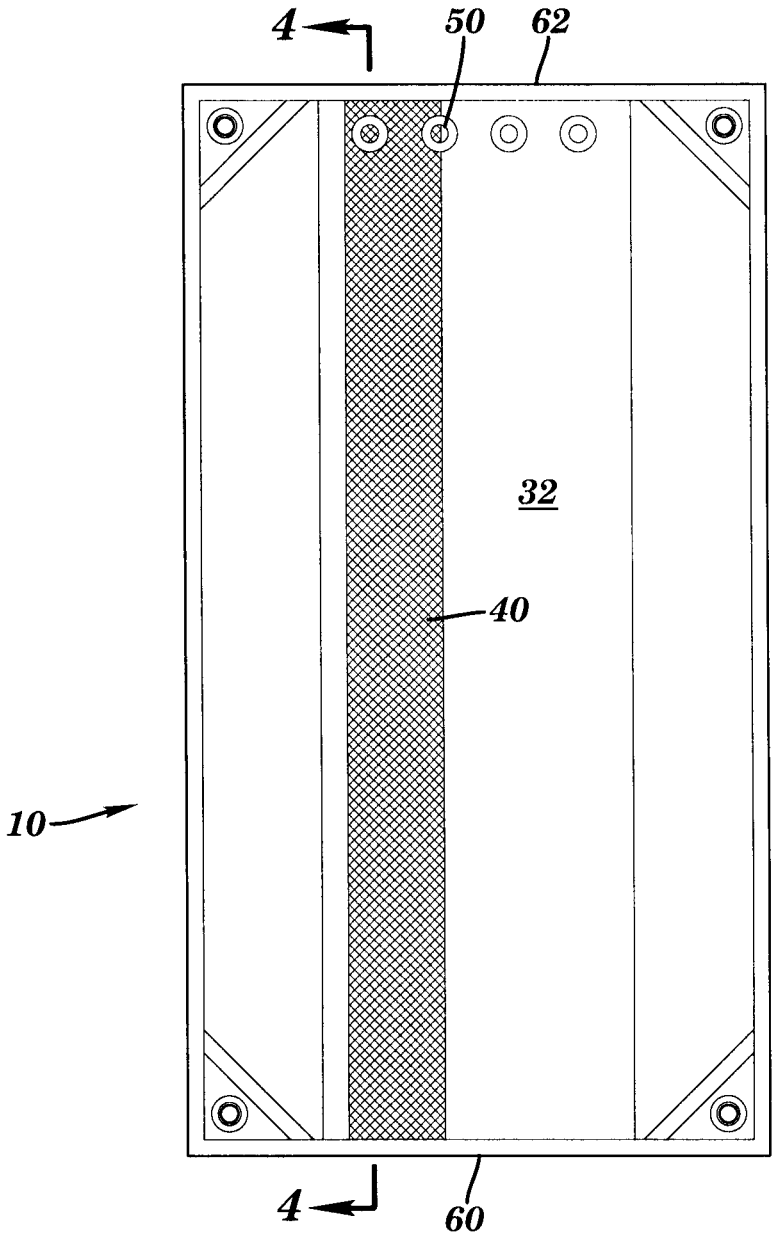
FIG. 2 is a front plan view of the system of FIG. 1.
Figure 3:
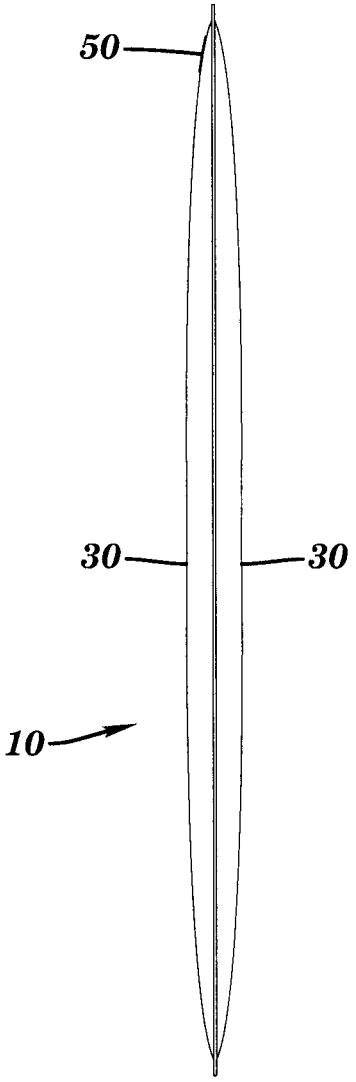
FIG. 3 is a side view of the system of FIG. 1.
Figure 4:
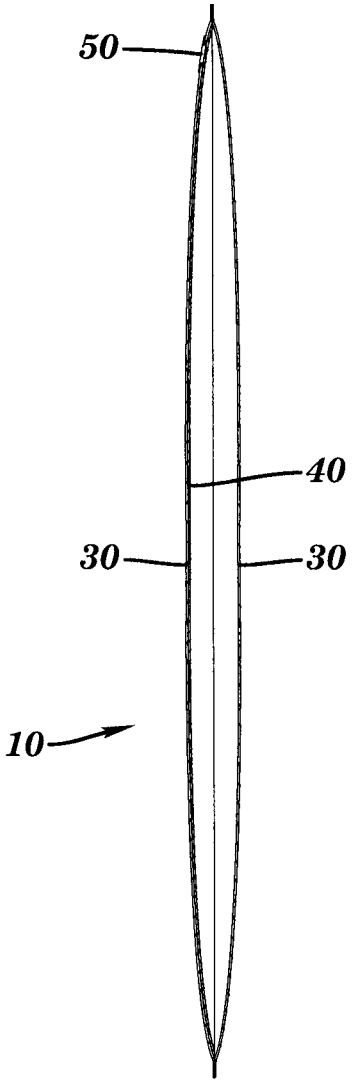
FIG. 4 is a cross-sectional view of the system of FIG. 3.

As depicted in FIGS. 1-3, conduit 40 may be longitudinally aligned vertically and port 50 may be located at or near a top end of conduit 40. Port 50 may be connected to a length of tubing 55 which may be connected to a pump 100 (e.g., a peristaltic pump). Container 10 may be filled with biopharmaceutical materials and container 10 may be emptied by pumping (e.g., via pump 100) the biopharmaceutical materials through a port (e.g., port 50) which may be located at a top end 62 of container 10. Conduit 40 may collapse with wall 32 to which the conduit is attached due to the pumping action by pump 100. The holes of the mesh forming conduit 40 may allow multiple entry locations for the biopharmaceutical materials held in container 10 to enter conduit 40 during evacuation (e.g., by pumping) of the interior of container 10. Further, conduit 40 may be collapsed in one or more locations along its length due to the collapse of the walls of container 10 (i.e., by pumping). The multiple openings in the mesh forming conduit 40 may also form multiple passages for the biopharmaceutical materials to flow through and/or along an interior or exterior of conduit 40 even when conduit 40 is collapsed.

Conduit 40 may thus collapse to ensure a minimal holdup volume remains in container 10 and such that the cross sectional area available for flow (i.e., through and/or along conduit 40) remains approximately constant along the length of conduit 40. For example, walls 30 could collapse around conduit 40 and conduit 40 could also collapse (e.g., forming a collapsed cylindrical shape) to create a new configuration of walls 30 around conduit 40 while allowing flow through and/or along a network of passages created by the mesh openings of conduit 40. Thus, even when the container 10 is fully collapsed, conduit 40 may also collapse, and liquid may still flow through or along the collapsed conduit 40 to the port.

The collapsibility of conduit 40 minimizes the 'hold-up' volume in conduit 40 and container 10, i.e., that volume which may be held inside the conduit and container that is not evacuated when desired, while the openings in the mesh allow the biopharmaceutical materials to flow even after the conduit has collapsed. For example, conduit 40 may be formed as collapsible cylinder, and in a collapsed state the conduit would hold less liquid volume therein than in a cylindrical shape. Further, the multiple holes in the mesh forming conduit 40 allows liquid to enter conduit 40 at multiple locations (i.e., instead of at one end or the other as in many prior art dip tubes) and further allows the liquid to flow longitudinally along conduit 40 through and between such openings in the mesh.

Also, when compressed (e.g., to form a flattened cylinder), the mesh tube forming conduit 40 creates a double layer of mesh material which has a large number of holes or perforations along its length through which fluid may enter the tube as described above. More specifically, as the mesh is collapsed by external forces, the mesh strands cross over each other and prevent full collapse by leaving open a network of passages through which fluid (e.g., biopharmaceutical material) may flow. Further, any potential sharp edges or corners that could otherwise be created by using planar materials (instead of a cylinder) may be avoided along the length of the mesh tube. To eliminate such sharp edges or corners at the two ends of the mesh tube, the ends of the mesh tube may be welded into the bag seams (i.e., seams of container 10) or they may be welded together using an impulse sealer and then trimmed to create a smooth edge.

The collapsibility of container 10 and conduit 40 may be controlled by the materials utilized in the container and conduit along with the flow rate by pump 100 in draining container 10. For example, a larger flow rate may cause a more rapid draining of the biopharmaceutical materials along with causing a more rapid collapsing of the container and conduit. Further, a rigid conduit may not collapse or collapse sufficiently such that a hold-up volume could remain in the conduit at the end of the draining. In contrast, a conduit which has the same flexibility as the container in which it is received could collapse such that a pump could no longer drain biopharmaceutical materials therefrom. The rigidity/flexibility of the conduit thus may be controlled such that it collapses relative to the container in response to pumping but does not collapse so completely or quickly that the contents of the container cannot be drained. Further, the geometry of a conduit may be configured to control the collapsibility such that the hold-up volume is minimized and recovery of the biopharmaceutical materials held in the container is maximized. A mesh (e.g., the mesh depicted in FIG. 5) such as that described above is advantageous since the contents of the container may flow along and/or through the conduit, including between the strands and through the perforations thereof, such that even if the conduit was collapsed, the walls of the container would not enter the perforations or gaps between the strands of mesh and the contents may flow along and/or through the conduit to the port.

Figure 6:
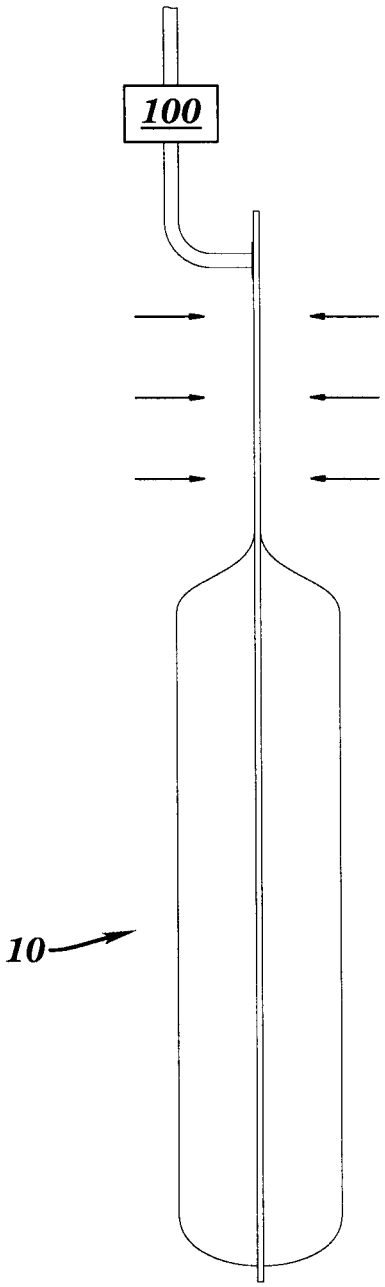
FIG. 6 is a side view of another embodiment of the present invention during an evacuation operation.
Figure 7:
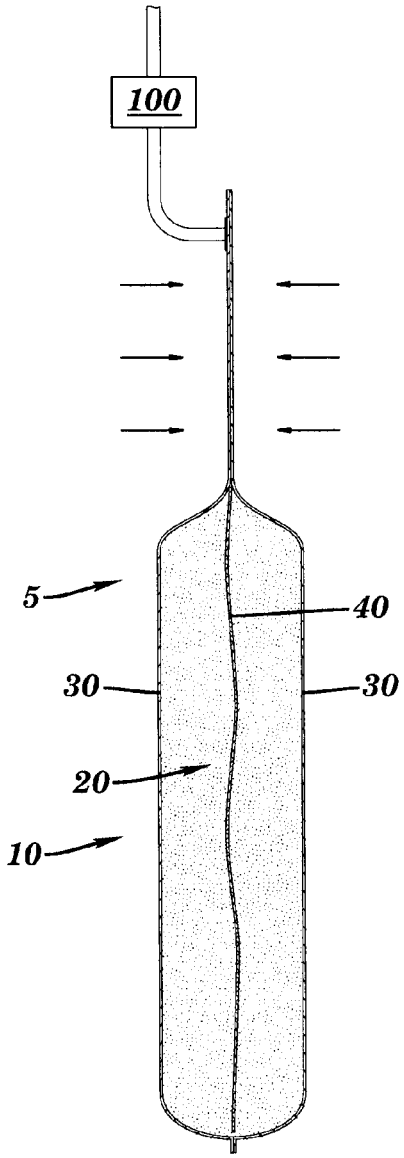
FIG. 7 is a side cross-sectional view of the system of FIG. 6 with the conduit therein depending vertically in a container.
Figure 8:
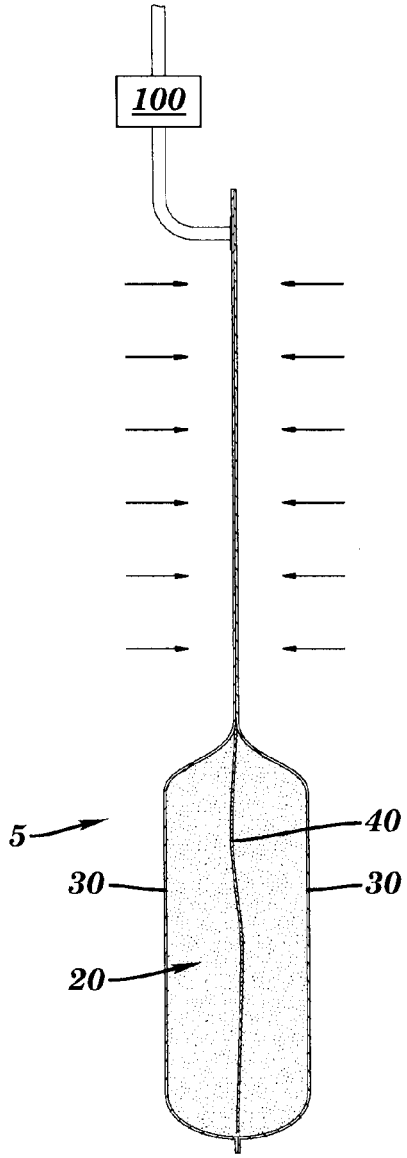
FIG. 8 is a side cross-sectional view of the system of FIG. 6 in a more evacuated state than FIG. 7.
Figure 9:
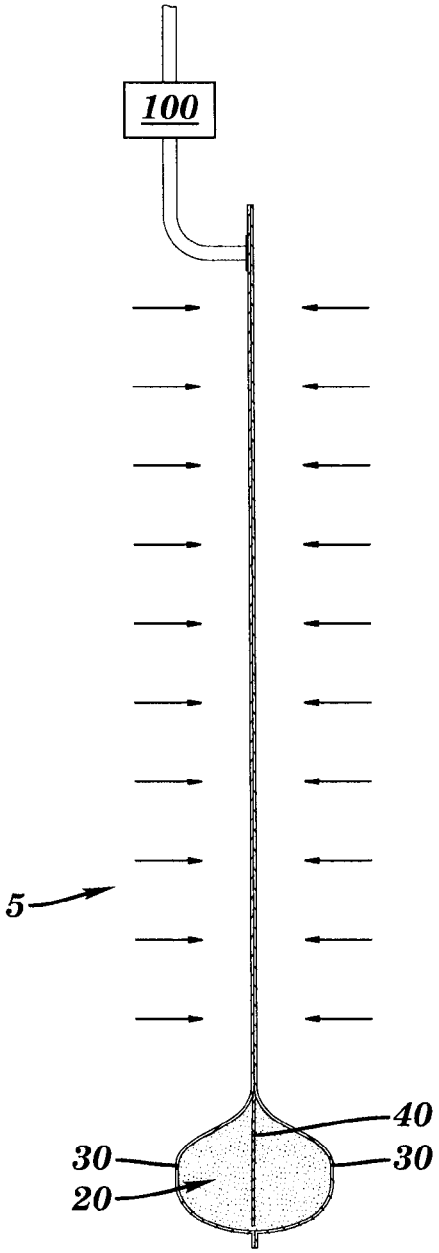
FIG. 9 is a side cross-sectional view of the system of FIG. 6 in a more evacuated state relative to FIGS. 7 and 8.
Figure 10:
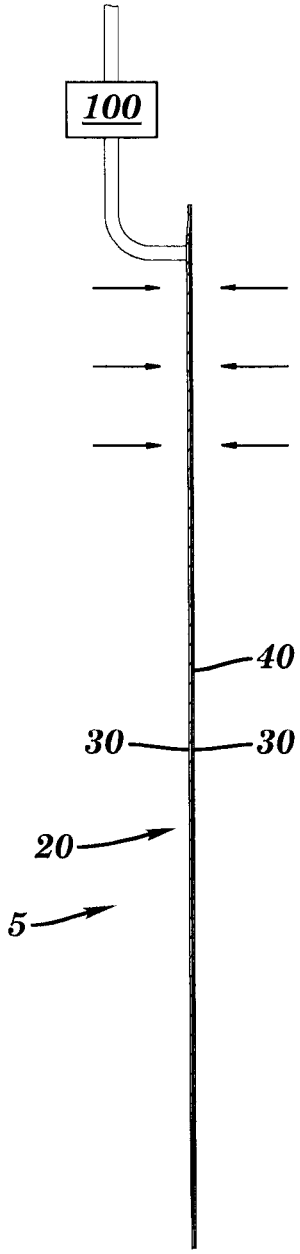
FIG. 10 is a side cross-sectional view of the system of FIG. 6 in a completely collapsed state.
Figure 11:
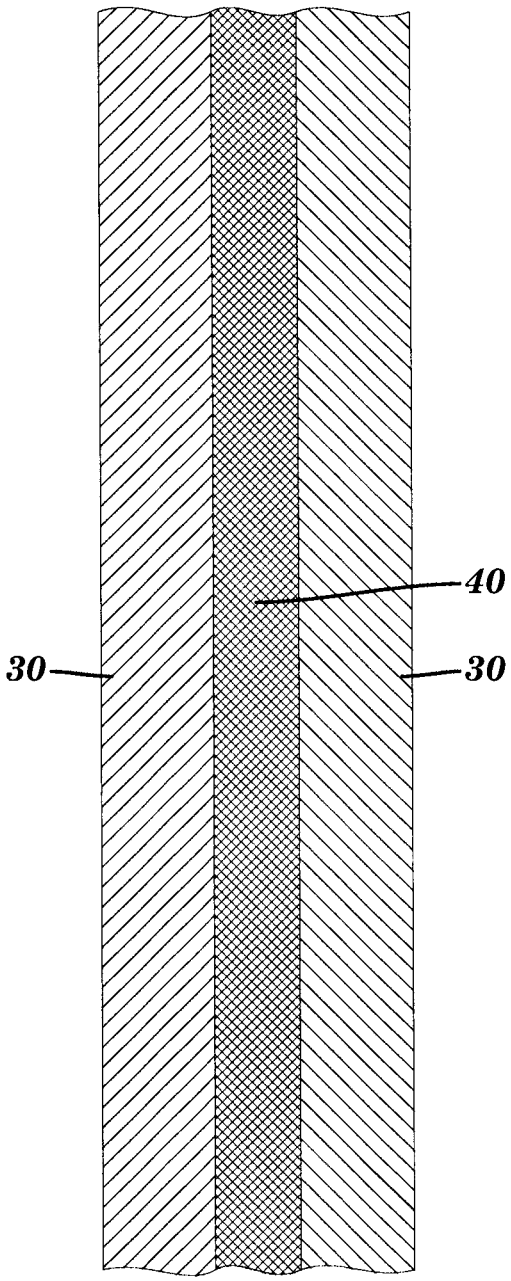
FIG. 11 is a close up cross-sectional view of a portion of the system of FIG. 10.
Figure 12:
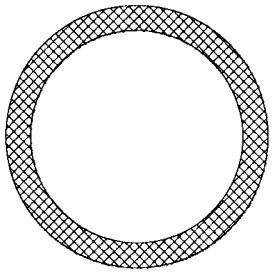
FIG. 12 is a cross-sectional view of a conduit of the system of FIG. 1 or FIG. 7 shaped cylindrically.
Figure 13:
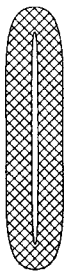
FIG. 13 is a cross-sectional view of the conduit of FIG. 1 or FIG. 7 shaped as a cylinder which is almost completely collapsed.

FIGS. 6-10 illustrate various stages of the collapsing of container 10. Conduit 40 in container 10 differs from the depiction of conduit 40 in FIGS. 1-4 in that conduit 40 in FIGS. 7-9 is attached to the inside surface of one of walls 30 only at a top portion thereof while most of conduit 40 depends vertically but does not connect to a remainder of container 10. In contrast, as described above, container 40 is attached to the wall along its entire length in FIGS. 1-4. FIGS. 6 and 7 illustrate the beginning stages of pumping by pump 100 connected to container 10. FIG. 8 depicts the container in a more collapsed state relative to FIG. 7, FIG. 9 depicts container 10 in a further collapsed state and FIG. 10 depicts the container in a fully collapsed state. A blow-up of a cross-section of container 10, as depicted in FIG. 10, is illustrated in FIG. 11 showing conduit 40 abutting walls 30 of container 10. FIG. 12 depicts conduit 40 in an uncollapsed cylindrical shape as may be present in uncollapsed portions of FIGS. 3-7. FIG. 13 depicts conduit 40 in an almost completely collapsed state (e.g., after further pumping of container 10 relative to FIG. 12) with a slight opening between opposite sides of conduit 40 such that an interior passage remains. The conduit as depicted in FIGS. 12 and 13 may be present in various portions along a length of conduit 40 as container 10 is controllably collapsed by the pumping of pump 100. For example, as depicted in FIG. 8, a top portion of conduit 40 closest to pump 100 may be completely collapsed or almost completely collapsed as depicted in FIG. 13. Portions of conduit 40 further away from pump 100 (i.e., in a lower uncollapsed portion of the container) in FIG. 8 may be shaped as depicted in FIG. 12, for example.

An example of a method for draining biopharmaceuticals from a container (e.g., container 10) is described as follows. Pump 100 may be coupled (e.g., connected via a length of tubing) to a port (e.g., port 50) of container 10 such that biopharmaceutical materials held in container 10 may be drained. As pump 100 drains biopharmaceutical materials from the container, the container collapses around conduit 40 based on the speed of pumping and flow rate by pump 100. It is desirable to minimize a hold up volume in conduit 40, i.e., that volume of biopharmaceutical materials which is held in the conduit and not removed therefrom by pumping. The pumping causes the biopharmaceutical materials to move along the exterior and/or interior of conduit 40 to allow the draining of the biopharmaceutical materials as the container collapses around conduit 40. The multiple perforations in conduit 40 allow for the flow of the biopharmaceutical materials along and/or through conduit 40 to promote the draining of the biopharmaceutical materials. As pumping progresses from a full container to an evacuated or almost evacuated container, conduit 40 may collapse in stages along its length such that it may have a shape such as depicted in FIG. 11 at the beginning of pumping which then may collapse such that it has an intermediate shape as depicted in FIG. 12 and which may then progress to a shape as depicted in FIG. 13. Conduit 40 may also have different shapes as it progresses from its starting shape, such as depicted in FIG. 11 to a collapsed or partially collapsed shape such as that depicted in FIG. 13.

Several experiments were run to determine the holdup volume and draining time for a 100 L container as a function of mesh tube diameter and the liquid being drained. The liquid was pumped out using heavy-wall silicone tubing and a peristaltic pump. Results are shown in the table below:

| Tube Diameter | Liquid | Draining Time | Holdup Volume |
|---|---|---|---|
| 2" | Water | 12 min | 169 mL |
| 2" | Sucrose solution (55 wt. %) | 25 min | 242 mL |
| 1" | Water | 14 min | 91 mL |
| 1" | Sucrose solution (55 wt. %) | 48 min | 104 mL |
| ½" | Water | 22 min | 43 mL |
| ½" | Sucrose solution (55 wt. %) | 109 min | 55 mL |

From these data it is clear that the smaller diameter tubes require more time to drain but have less holdup volume. Given the high value of some biological materials it may be advantageous to specify a smaller tube diameter, even if more time is required for draining. The viscosity of the sucrose solution is higher than that of water (nearly 50×) and takes longer to drain. In all cases the bag collapsed smoothly and completely leaving minimal wrinkling.

Figure 14:
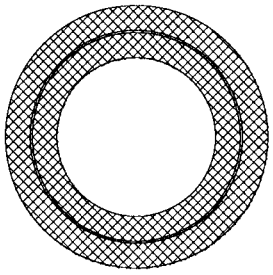
FIG. 14 is a cross-sectional view of another embodiment of a conduit for use in the system of FIG. 1 which includes a second conduit located coaxially inside the first.
Figure 15:
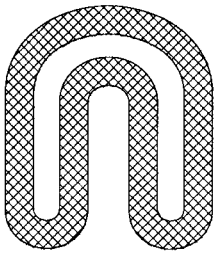
FIG. 15 is a cross-sectional view of another example of a conduit for use in the system of FIG. 1 which includes a cylindrical conduit folded upon itself such that the two outermost ends almost touch.
Figure 16:
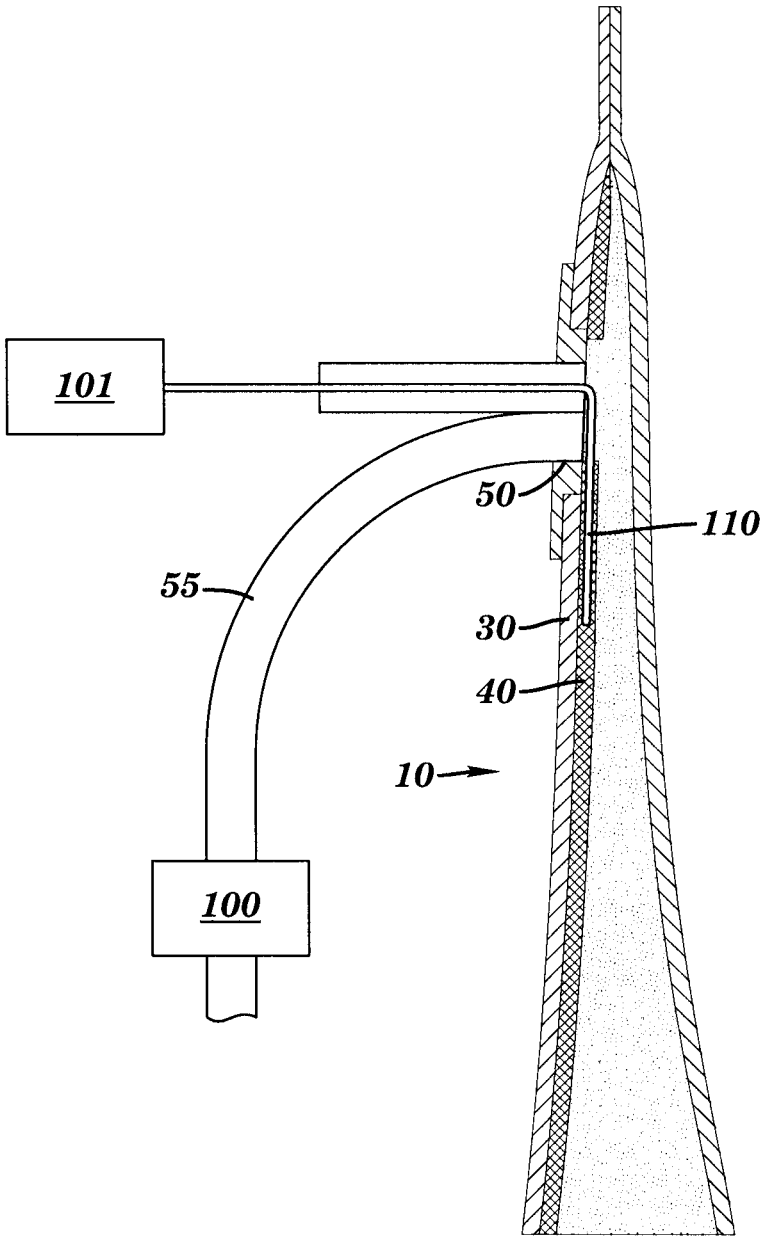
FIG. 16 is a side cross-sectional view of another embodiment of a system for storing biopharmaceutical materials which includes a probe located inside a conduit inside a container.

The use of a mesh tube for conduit 40 provides a more rigid structure relative to container 10 and other prior art alternatives, which minimizes folding or twisting of the container and conduit in the area of conduit 40. As described, conduit 40 may be welded to the bag film (or to an interposing latch if needed) on either side of the conduit; there is no preferred side and it therefore provides more flexibility in construction. Also, the mesh may be welded into the bag seam with a conventional impulse sealer. Other variations of the conduit (e.g., conduit 40) and the container (e.g., container) described above could include a conduit formed of a first cylindrical tube inside a second cylindrical tube as depicted in cross-section in FIG. 14, a (previously cylindrical) tube at least partially flattened and its ends folded toward each other as depicted in FIG. 15 in cross-section, and the insertion of a probe (e.g., a probe 110), such as a sampling tube or a sensor (e.g. a thermocouple), inside the mesh of conduit 40, as depicted in FIG. 16. In this latter example, the mesh may protect the probe and aid in positioning, while the probe may be coupled to a controller, e.g., a controller 101, configured to interpret any data received from the probe.

Although the conduits (e.g., conduit 40) described above are formed of mesh, one skilled in the art will recognize that other materials may be used which are partially and controllably collapsible, and which are located with one end at least partially crossing a drain port (e.g., port 50) of the container in which they are received and the other end of the conduit may extend toward, or to, a furthest extent of the container, and have multiple perforations along its length. Further, although the conduits described above are described as being collapsible and cylindrical, the conduits could be of any shape which is partially and controllably collapsible and has a plurality of perforations along its length to facilitate flow of biopharmaceutical materials toward a drain to which the conduit extends. Further, relative to the example depicted in FIG. 15, although the conduit is depicted as a first end of a collapsed cylindrical conduit being folded toward a second end such that an interior space remains between the layers of the collapsed conduit, the layered ends could connect to one another and/or the interior space could be minimized such that the layers of the folded flattened cylinder abut or almost abut one another. Similarly, although FIG. 14 depicts a first cylindrical mesh conduit inside a second cylindrical mesh conduit such that an outer circumference of the inner conduit abuts an inner circumference of the outer conduit, a space could remain between the two conduits and/or the two mesh conduits concentrically aligned could be folded and/or flattened in any number of ways. Further, the concentric cylinder could have a shape other than cylindrical.

Also, the perforations and openings described above which are formed in the conduits (e.g., conduit 40) could be formed in the conduits by any method, such as piercing, puncturing, drilling, casting, molding, or any other means of providing a length of conduit having holes connecting an interior and an exterior thereof. Further, the perforations or openings may be formed in any shape and may be spaced from one another at various distances from one another, which may be regular or irregular.

In addition to the shape depicted in the figures, container 10 may have any useful geometry. Also, container 10 may be formed of a laminated film which includes a plurality of layers. Also a biocompatible product-contacting layer of the interior of flexible container 10 may be formed of a low density polyethylene, very low density polyethylene, ethylene vinyl acetate copolymer, polyester, polyamide, polyvinylchloride, polypropylene, polyfluoroethylene, polyvinylidenefluoride, polyurethane or fluoroethylenepropylene, for example. A gas and water vapor barrier layer may also be formed of an ethylene/vinyl alcohol copolymer mixture within a polyamide or an ethylene vinyl acetate copolymer. Further, flexible container 10 may include a layer with high mechanical strength (e.g. a polyamide), and an external layer with insulating effect to heat welding, for example, polyester. The layers may be compatible with warm and cold conditions and may be able to withstand ionizing and gamma irradiation for sterilization purposes.

Container 10 may be adapted to receive and contain frozen and/or liquid biopharmaceutical materials. In an embodiment, the biopharmaceutical materials may comprise protein solutions, protein formulations, amino acid solutions, amino acid formulations, peptide solutions, peptide formulations, DNA solutions, DNA formulations, RNA solutions, RNA formulations, nucleic acid solutions, nucleic acid formulations, antibodies and their fragments, enzymes and their fragments, vaccines, viruses and their fragments, biological cell suspensions, biological cell fragment suspensions (including cell organelles, nuclei, inclusion bodies, membrane proteins, and/or membranes), tissue fragments suspensions, cell aggregates suspensions, biological tissues in solution, organs in solution, embryos in solution, cell growth media, serum, biologicals, blood products, preservation solutions, fermentation broths, and cell culture fluids with and without cells, mixtures of the above and biocatalysts and their fragments.

While the invention has been depicted and described in detail herein, it will be apparent to those skilled in the relevant art that various modifications, additions, substitutions and the like can be made without departing from the spirit of the invention and these are therefore considered to be within the scope of the invention as defined in the following claims.

The invention claimed is:

1. A system for storing biopharmaceutical materials, said system comprising:

a plurality of flexible walls bounding an interior of a container for holding biopharmaceutical materials therein;

at least one port connected to a first wall of said walls and providing fluid communication between said interior and an exterior to allow a draining of said interior; and a collapsible conduit having a plurality of perforations along said conduit, said plurality of perforations configured to allow a flow of the biopharmaceutical materials from the exterior to the interior of said conduit;

said conduit having a cross sectional area transverse to a length of said conduit, and said conduit extending from one of said at least one port toward an opposite end of said interior;

said conduit being collapsible by said flexible walls and forming a reduced cross sectional area when said container is drained to allow a flow of the biopharmaceutical materials through and/or along said conduit to said port said conduit comprising a first interior surface facing a second interior surface about an interior of said conduit, said first surface and said second surface contacting each other across a width of said conduit upon being flattened by the draining of said container, the flattening of the conduit minimizing a hold up volume of the conduit.

2. The system of claim 1 wherein said conduit is connected to said first wall.

3. The system of claim 1 wherein an entire length of said conduit is connected to said first wall.

4. The system of claim 1 further comprising a second wall of said walls opposite said first wall about said at least one port, said conduit connected to said second wall.

5. The system of claim 1 wherein said conduit directly contacts said first wall and a second wall of said plurality of walls such that a passage for a flow of the biopharmaceutical materials is provided between said first wall and said second wall.

6. The system of claim 1 wherein said conduit consists of a nonwoven mesh.

7. The system of claim 1 wherein said conduit consists of a mesh cylinder.

8. The system of claim 1 wherein said conduit consists of a flattened mesh cylinder.

9. The system of claim 1 wherein said conduit is more rigid than said first wall.

10. The system of claim 1 wherein said conduit consists of a first mesh cylinder located axially within a second mesh cylinder.

11. The system of claim 1 wherein said conduit consists of a mesh cylinder, said conduit flattened and folded along a longitudinal dimension of said conduit such that four layers of said conduit are located such that a bottom layer contacts said container, a second layer contacts said bottom layer, a third layer contacts said second layer, and a top layer contacts said third layer.

12. The system of claim 1 further comprising a probe located in said at least one port, said probe configured to measure at least one characteristic of said interior of said container.

13. A method for removing biopharmaceutical materials from a flexible container, the method comprising:

pumping the biopharmaceutical materials through and/or along a collapsible conduit in an interior of the flexible container to a port of the flexible container, the port providing fluid communication between the interior of the flexible container and an exterior of the flexible container; a plurality of perforations of the collapsible conduit allowing flow of the biopharmaceutical materials from an exterior to an interior of the conduit; and the conduit extending from the port toward an opposite end of the interior;

a first interior surface of the conduit facing a second interior surface of the conduit about an interior of the conduit, the pumping causing the conduit to collapse such that the conduit is flattened and the first surface and the second surface contact each other across a width of the conduit to minimize a hold up volume of the conduit.

14. The method of claim 13 wherein the conduit comprises a plurality of perforations along the length of the conduit and further comprising causing flow through the plurality of perforations by the pumping.

15. The method of claim 13 wherein the collapsible conduit comprises a cylindrical mesh and further comprising collapsing the conduit by the pumping to form a collapsed cylindrical mesh.

16. The method of claim 13 wherein the collapsible conduit comprises a first circumferential internal surface and a second circumferential internal surface and wherein the pumping causes the collapsible conduit to collapse to cause the first circumferential internal surface to contact the second circumferential internal surface such that the collapsible conduit is a flattened cylindrical conduit.

17. The method of claim 13 wherein the conduit consists of a mesh cylinder, the conduit flattened and folded along a longitudinal dimension of the conduit such that four layers of the mesh are located such that a bottom layer contacts the container, a second layer contacts the bottom layer, a third layer contacts the second layer, and a top layer contacts the third layer.

18. The method of claim 13 further comprising locating a probe in the conduit and the probe measuring at least one characteristic of the interior of the container.

* * * * *